United States Patent [19]

Ponchel et al.

[11] Patent Number: 4,954,188

[45] **Date of Patent: * Sep. 4, 1990**

[54] HIGH STRENGTH ALUMINUM ALLOY RESISTANT TO EXFOLIATION AND METHOD OF MAKING

[75] Inventors: Basil M. Ponchel, Tarentum; James D. Walsh, Cheswick, both of Pa.

[73] Assignee: Aluminum Company of America, Pittsburgh, Pa.

[ * ] Notice: The portion of the term of this patent subsequent to May 9, 2006 has been disclaimed.

[21] Appl. No.: 280,876

[22] Filed: Dec. 7, 1988

Related U.S. Application Data

[63] Continuation of Ser. No. 85,666, Aug. 13, 1987, Pat. No. 4,828,631, which is a continuation-in-part of Ser. No. 630,998, Jul. 16, 1984, abandoned, which is a continuation-in-part of Ser. No. 333,684, Dec. 23, 1981, abandoned.

[51] Int. Cl.[5] ..... C22C 21/10; C22F 1/053

[52] U.S. Cl. ..... 148/417; 148/12.7 A

[58] Field of Search ..... 148/2, 11.5 A, 12.7 A, 148/159, 417; 420/532

[56] References Cited

U.S. PATENT DOCUMENTS 2,403,037 7/1946 Zeigler et al. ..... 148/417

3,762,916 10/1973 Kirman ..... 148/12.7 A

*Primary Examiner*—Deborah Yee

*Attorney, Agent, or Firm*—Andrew Alexander

[57] ABSTRACT

A method is provided for producing a high strength aluminum alloy characterized by improved resistance to exfoliation. The method comprises providing an aluminum-base alloy comprising 5.9 to 8.2 wt. % zinc, 1.5 to 4.0 wt. % magnesium, 1.5 to 3.0 wt. % copper, less than 0.001 wt. % boron not more than 0.04 wt. % chromium, and 0.5 wt. % maximum other alloying elements such as zirconium, manganese, iron, silicon and titanium, with the balance consisting of aluminum, working the alloy into a product of predetermined shape, solution heat treating the shaped product, quenching, and aging the heat treated and quenched product to a temperature of from above 270° F. to 285° F. for a period of from 6 to 30 hours.

17 Claims, 4 Drawing Sheets

CONTROL

16 HOURS AT 275° F.

12 HOURS AT 275° F.

12 HOURS AT 275° F.

16 HOURS AT 275° F.

CONTROL

HIGH STRENGTH ALUMINUM ALLOY RESISTANT TO EXFOLIATION AND METHOD OF MAKING

CROSS REFERENCE TO RELATED APPLICATIONS

This application is a continuation of U.S. Ser. No. 085,666, filed Aug. 13, 1987, now U.S. Pat. No. 4,828,631 which is a continuation-in-part of U.S. Ser. No. 630,998, filed July 16, 1984 (now abandoned), which is a continuation-in-part of U.S. Ser. No. 333,684, filed Dec. 23, 1981 (now abandoned).

BACKGROUND OF THE INVENTION

Aluminum alloys in the 7000 series containing high amounts of zinc, copper and magnesium are known for their high strength-to-weight ratios and, therefore, find application in the aircraft industry. Such applications, however, result in exposure to a wide variety of climatic conditions necessitating careful control of working and aging conditions to provide adequate strength and resistance to corrosion, including both stress corrosion and exfoliation.

Conventional alloys of this type such as 7075, which contain 3 to 8 wt. % Zn, 1.5 to 5 wt. % Mg and 0.75 to 2 5 wt. % Cu, can be aged at a temperature of about 215° F. to 250° F. to obtain excellent strength properties in what is known as the T6 temper. High resistance to exfoliation and stress corrosion with some sacrifice in strength can be achieved by subsequently aging the alloy at temperatures of 300° F. to 350° F. for a sufficient period of time to achieve what is known as a T7 temper In some instances, modifications of the above tempers have been successfully made by careful control of the amounts of alloying materials combined with the use of elevated temperatures. For example, Staley et al, U.S. Pat. No. 3,881,966, disclose and claim a method for obtaining a 7000 series alloy exhibiting high strength and high resistance to stress corrosion utilizing an aging temperature of 300° F. to 380° F. in combination with careful control of the ratio of alloying constituents.

Aging at lower temperatures to achieve the same results has also been accomplished using other alloying constituents. For example, Markworth et al, U.S. Pat. No. 3,794,531, teaches the use of single stage aging at a temperature of 212° F. to 284° F. by substituting 2% of the zinc content with cadmium.

The use of nickel as an additive in 7000 series alloys to achieve resistance to stress corrosion is taught by Zeigler et al in U.S. Pat. No. 2,403,037. This alloy is said to be aged in a single step at temperatures of 275° F. to 350° F.

While the use of a single step aging process has advantages from the standpoint of efficiency and energy conservation, the continuing search for alloys with higher strength properties compounds the problem of maintaining the desired resistance to stress corrosion as well as resistance to exfoliation.

Thus, the prior art seems to indicate that such properties can be maintained using aging temperatures of over 300° F. with or without a prior aging step at lower temperatures. It was, therefore, quite surprising and disconcerting to find that the use of such aging (i.e., over 300° F.) on high strength alloy similar to that disclosed in the aforementioned Staley et al patent (U.S. Pat. No. 3,881,966) resulted in lowered resistance to exfoliation if aging at temperatures of over 300° F. was carried out over a short period of time (less than 7 hours at 325° F., for example) and a loss in tensile strength if the aging period was extended.

SUMMARY OF THE INVENTION

Quite unexpectedly, it was discovered that the desired Properties could be achieved in this alloy by lowering the aging temperature rather than raising the temperature as taught in the prior art.

Thus, in accordance with the preferred embodiment of the invention, an aluminum-base alloY having T6 strength properties and improved resistance to exfoliation is provided having, as alloying constituents and impurities: 5.9 to 8.2 wt. % zinc, 1.5 to 3.0 wt. % copper, 1.5 to 4.0 wt. % magnesium, 0.08 to 0.15 wt. % zirconium, 0.05 to 0.10 wt. % manganese, 0 to 0.04 wt. % chromium, 0 to 0.06 wt. % titanium, 0 to 0.12 wt. % silicon and 0 to 0.15 wt. % iron, less than 0.01 wt. % boron, not more than 0.05 wt. % of individual unidentified impurities and not more than 0.15 wt. % total unidentified impurities with the balance consisting of aluminum. The alloy product is subjected to hot working, solution heat treating and quenching followed by an aging process which consists of maintaining the alloy at a temperature of from above 270° F., to 285° F. for a period of from 6 to 30 hours.

DETAILED DESCRIPTION OF THE PREFERRED EMBODIMENTS

In accordance with the invention, an improved high strength 7000 series aluminum alloy is provided having specific controlled amounts of alloying constituents and isothermally aged in a single step process.

Figure 1:
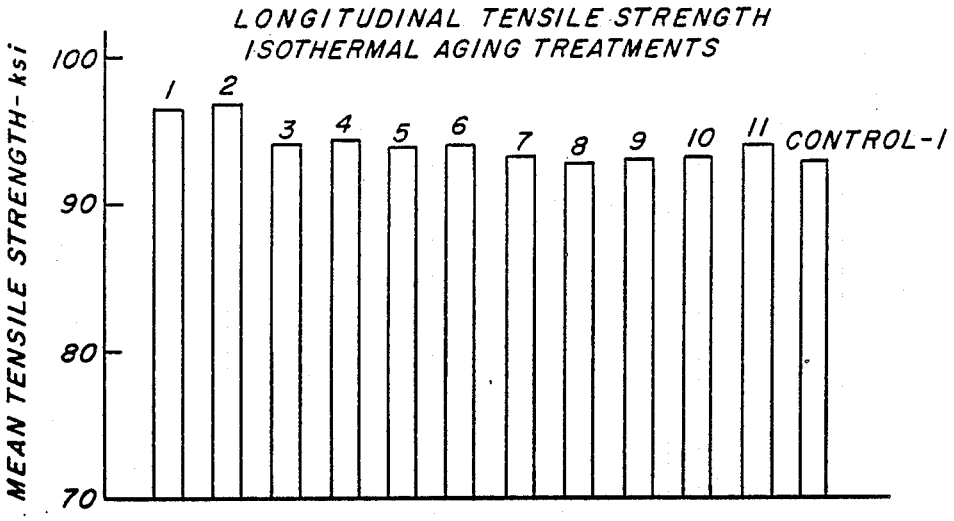
FIG. 1 is a bar graph illustrating the longitudinal tensile strength achieved using various aging conditions.
Figure 2:
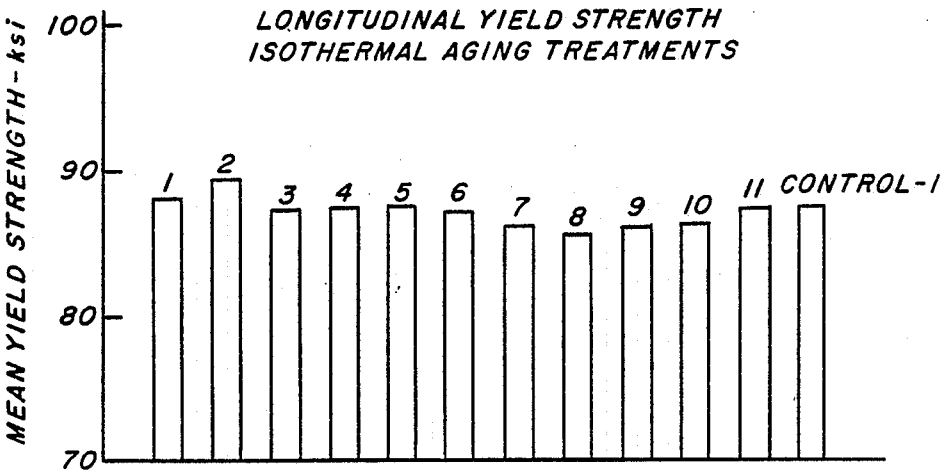
FIG. 2 is a bar graph illustrating the longitudinal yield strength achieved using various aging conditions
Figure 3:
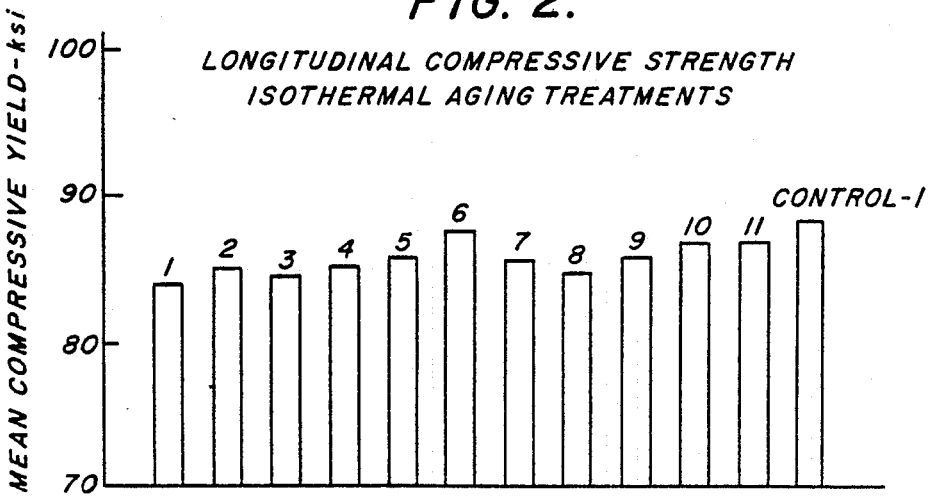
FIG. 3 is a bar graph illustrating the longitudinal compressive yield strength achieved using various aging conditions.
Figure 4:
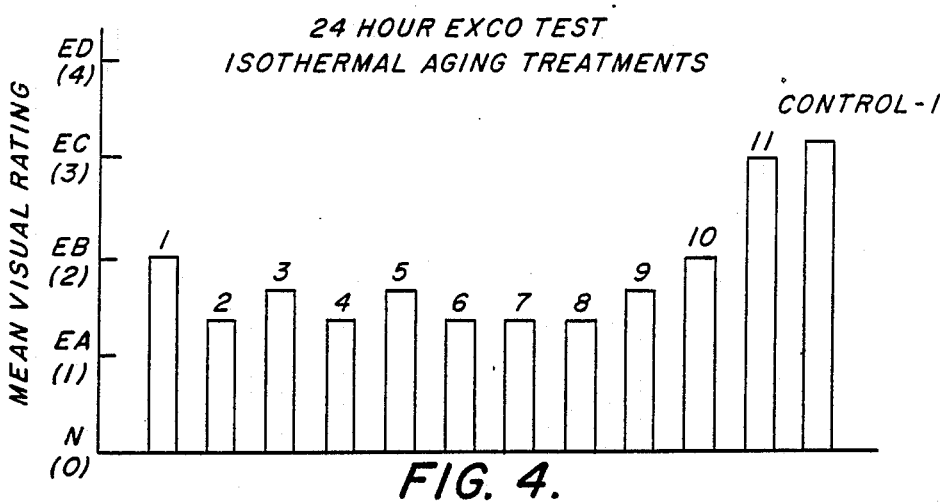
FIG. 4 is a bar graph illustrating the resistance to exfoliation achieved after a 24-hour EXCO Test using various aging conditions.
Figure 5:
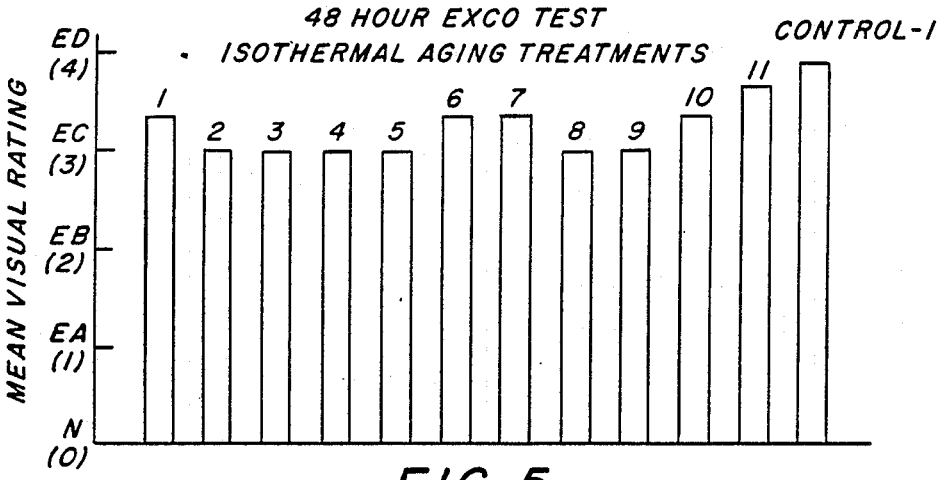
FIG. 5 is a bar graph illustrating the resistance to exfoliation after a 48-hour EXCO Test using various aging conditions.
Figure 6:
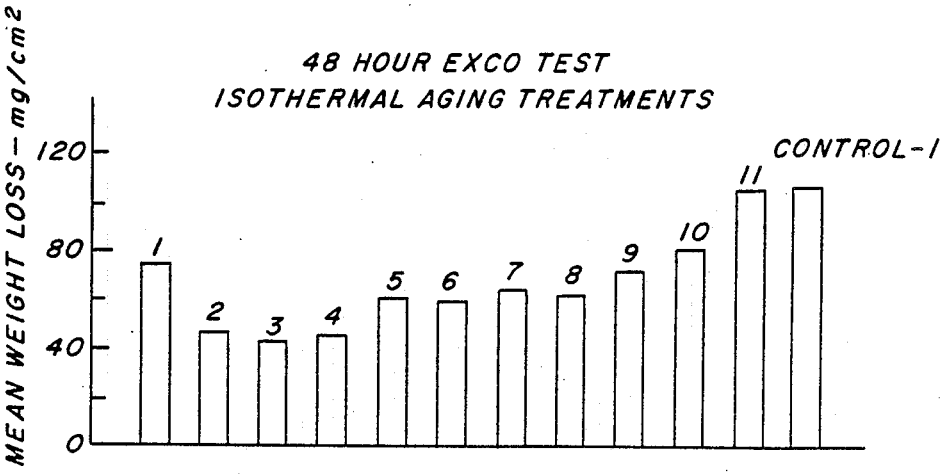
FIG. 6 is a bar graph illustrating the weight loss after a 48-hour EXCO Test using various aging conditions
Figure 7:
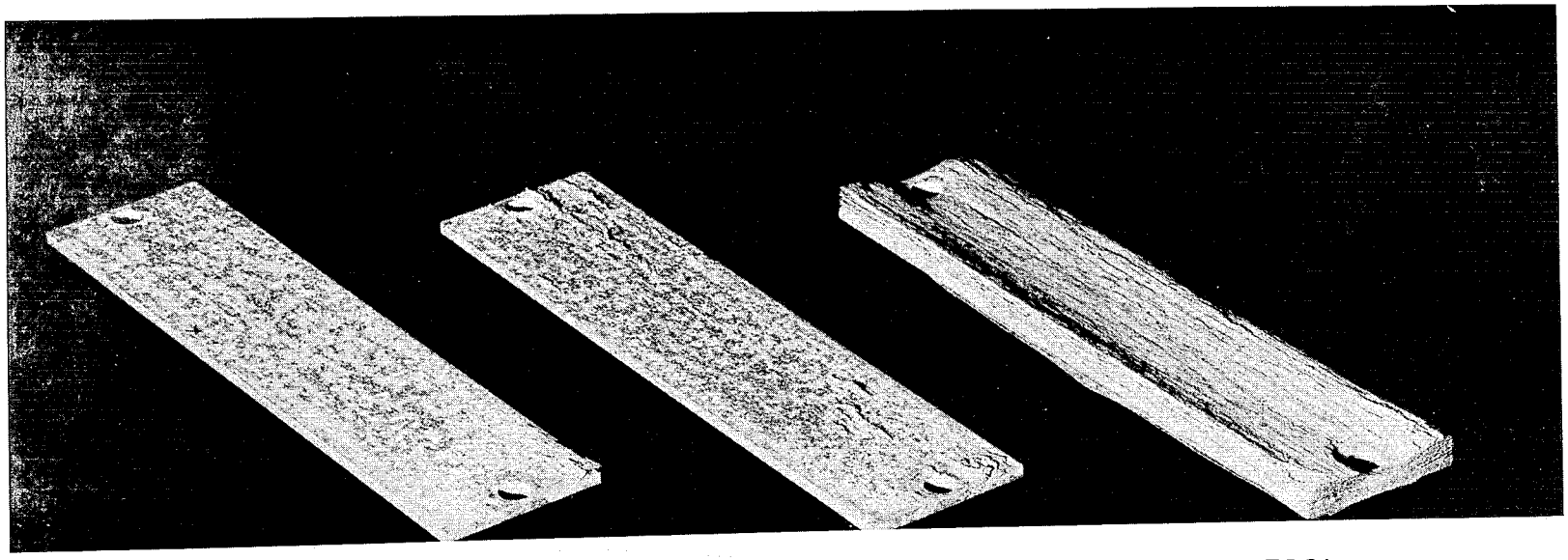
FIG. 7 is a photograph illustrating 1-year exposure of 0.156 inch samples prepared in accordance with the invention as well as a control.
Figure 8:
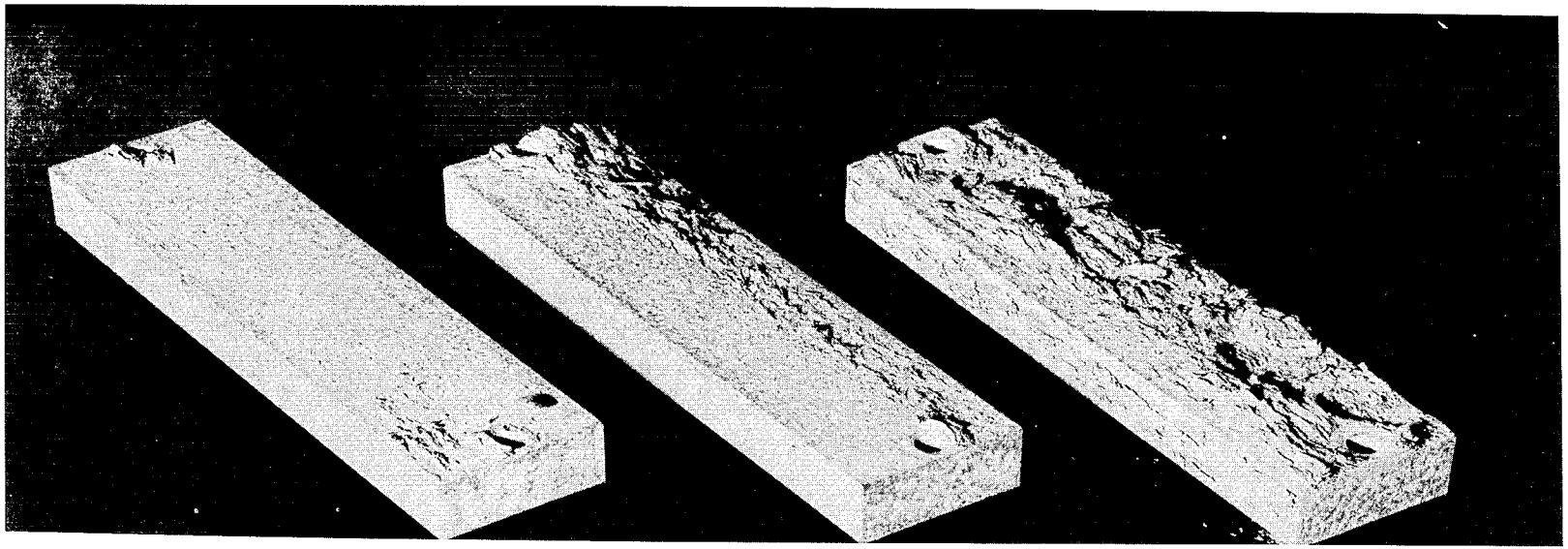
FIG. 8 is a photograph illustrating 1-year exposure of 0.80 inch samples prepared in accordance with the invention as well as a control.

The alloy of the invention contains the following ingredients: 5.9 to 8.2 wt. % zinc, preferably 5.9 to 6.9 wt. %; 1.5 to 4.0 wt. % magnesium, preferably 2.0 to 2.7 wt. %; 1.5 to 3.0 wt. % copper, preferably 1.9 to 2.5 wt. %; 0.05 to 0.25 wt. % zirconium, preferably 0.08 to 0.15 wt. %; less than 0.01 wt. % boron, preferably less than 0.008 wt. % boron and not more than the following amounts of other alloying materials and impurities: 0.1 wt. % manganese, 0.04 wt. % chromium, 0.06 wt. % titanium, 0.12 wt. % silicon, 0.15 wt. % iron and 0.05 wt. % of individual unidentified impurities with a maximum total of 0.15 wt. % of unidentified impurities. The alloy develops improved resistance to exfoliation by aging at a temperature of from above 270° F. to 285° F. for a period of from 6 to 30 hours. That is, the improves resistance is characterized by significantly decreasing the rate at which exfoliation takes place, as well be seen by comparing the control and invention samples after exposure, as shown in FIGS. 7 and 8.

The alloy of the invention is useful in the production of extruded products, rolled materials such as sheet or plate, or in the form of forgings with the greatest benefit being obtained in extruded products, particularly with respect to 7150 type alloy. It can be used in the form of thin products such as sheets as well as in heavier thicknesses such as plate without appreciable differences in yield strength due to differing quench rates.

The alloy of the invention having improved exfoliation resistance may be fabricated into various shapes and forms using conventional procedures as described in the aforementioned Staley et al patent (U.S. Pat. No. 3,881,966). For example, the alloy composition may be provided as a continuously direct chilled cast ingot which is first subjected to an elevated temperature of about 850° F. to 900° F. for a period sufficient to homogenize its internal structure and uniformly distribute the alloying constituents therein. The material is then hot worked and, if desired, cold worked to produce the desired product. As previously discussed, these working conditions may include rolling, extruding or forging as well as any other known metal working procedures useful in fabricating aluminum structures. Intermediate annealing or reheating can also be employed if desired during the metal working steps if needed to produce the final desired product. The final product may be of relatively thick cross section, for example, 2 to 4 inches or more in thickness, or it maY be a relatively thin section of less than ¼ inch. Regardless of thickness, the alloy product will exhibit a very satisfactory yield strength and improved resistance to exfoliation when aged in accordance with the invention and at little or no expense in stress corrosion resistance.

The product, e.g. plate, sheet or extrusion, is typically solution heat treated at a temperature of 860° F. or higher for a sufficient time for solution effects to approach equilibrium and then quenched. Quenching can be accomplished in a number of ways in view of the surprising lack of quench sensitivity possessed by the preferred alloys, e.g., 7150 type, useful in the invention. For example, the product can be quenched by spraying with cold water or immersed in room temperature water.

The heat treated and quenched product is then aged to develop its strength and improved resistance to exfoliation. The aging is carried out for a period of from 6 to 30 hours at a temperature of from about 265° F. to 290° F. and preferably above 270° F. to 285° F., most preferably 271° F. to 280° F. and typically at 275° F.±one degree. That is, aging is done in one step under isothermal conditions.

The following examples will serve to further illustrate the invention.

EXAMPLE 1

Extrusions of 0.156, 0.250 and 0.80 inch were prepared and subjected to various aging times and temperatures, including a two-step aging process illustrative of the prior art wherein the sample is aged for up to 20 hours at a temperature of 250° F. or less followed by a second step at a temperature of 325° F. for about 5 hours. The alloy used contained (in parts by weight) 5.9 to 6.9 parts zinc, 2.0 to 2.7 parts magnesium, 1.9 to 2.5 parts copper, 0.1 part manganese, less than 0.04 part chromium, less than 0.08 to 0.15 part zirconium, less than 0.06 part titanium, less than 0.12 part silicon, less than 0.15 part iron and less than 0.15 part of unidentified impurities, with the balance aluminum. The extrusions were all solution heat treated at 890° F. to 900° F., cold water quenched and then stretched 1½ to 2% prior to the aging step. After aging, the samples were measured for tensile and compression strength properties and then subjected to the EXCO Exfoliation Test defined in ASTM G34-79. The results are tabulated in Tables I, II and III, which differentiate between the three thicknesses of samples and in FIGS. 1 through 6 in which the results for the three thicknesses have been averaged. The results clearly indicate that samples 3 through 6, which were aged in accordance with the invention, regardless of thickness, maintain physical strength characteristics at least comparable to that achieved using the prior art of two-step aging process while providing marked improvement in exfoliation characteristics, as evidenced both by the visual ratings of the EXCO Test and by weight loss measurements.

TABLE I

MECHANICAL PROPERTY AND ACCELERATED EXFOLIATION TESTS, 0.156 IN THICK SAMPLES

| | Aging Treatment | | Longitudinal Properties | | | | 24 Hr. EXCO Test | 48 Hr. EXCO Test | |
|---|---|---|---|---|---|---|---|---|---|
| | | | Tensile | | | Compressive Yield Strength (1) | ASTM Visual Rating (2) | ASTM Visual Rating (2) | Weight Loss mg/cm² |
| Sample No. | Time (hr) | Temp. (°F.) | T.S. ksi | Y.S. (1) ksi | % El. | ksi | | | |
| Control-1 | | | 92.1 | 86.2 | 10.2 | 87.2 | E-D | E-D | 110 |
| Control-2 | | | 92.2 | 86.5 | 10.0 | 86.8 | E-C | E-D | 115 |
| 1 | 12 | 250 | 95.1 | 85.6 | 13.2 | 82.4 | E-B | E-C | 53 |
| 2 | 24 | 250 | 95.1 | 86.7 | 13.2 | 83.8 | E-A | E-C | 32 |
| 3 | 8 | 275 | 92.2 | 84.2 | 12.2 | 82.7 | E-A | E-C | 37 |
| 4 | 12 | 275 | 92.4 | 83.8 | 13.2 | 83.6 | E-A | E-C | 41 |
| 5 | 16 | 275 | 92.3 | 84.3 | 12.2 | 83.3 | E-A | E-C | 43 |
| 6 | 24 | 275 | 92.8 | 84.3 | 12.2 | 83.6 | E-B | E-D | 63 |
| 7 | 4 | 300 | 92.0 | 83.3 | 14.2 | 83.0 | E-B | E-D | 66 |
| 8 | 8 | 300 | 90.4 | 81.7 | 12.2 | 83.1 | E-B | E-C | 54 |
| 9 | 12 | 300 | 90.7 | 82.3 | 12.2 | 83.4 | E-B | E-C | 52 |
| 10 | 16 | 300 | 91.2 | 83.3 | 12.2 | 84.8 | E-B | E-C | 63 |

TABLE I-continued

MECHANICAL PROPERTY AND ACCELERATED EXFOLIATION TESTS, 0.156 IN THICK SAMPLES

| | Aging Treatment | | Longitudinal Properties Tensile | | | Compressive Yield | 24 Hr. EXCO Test | 48 Hr. EXCO Test | |
|---|---|---|---|---|---|---|---|---|---|
| Sample No. | Time (hr) | Temp. (°F.) | T.S. ksi | Y.S. (1) ksi | % El. | Strength (1) ksi | ASTM Visual Rating (2) | ASTM Visual Rating (2) | Weight Loss mg/cm$^2$ |
| 11 | 24 | 300 | 93.0 | 85.3 | 13.2 | 85.6 | E-C | E-D | 112 |

Notes:
(1) Offset equals 0.2%
(2) Ratings based upon ASTM standards for exfoliation (Designation G-34-79) with A through D categories, D being most severe.

TABLE II

MECHANICAL PROPERTY AND ACCELERATED EXFOLIATION TESTS, 0.156 IN THICK SAMPLES

| | Aging Treatment | | Longitudinal Properties Tensile | | | Compressive Yield | 24 Hr. EXCO Test | 48 Hr. EXCO Test | |
|---|---|---|---|---|---|---|---|---|---|
| Sample No. | Time (hr) | Temp. (°F.) | T.S. ksi | Y.S. (1) ksi | % El. | Strength (1) ksi | ASTM Visual Rating (2) | ASTM Visual Rating (2) | Weight Loss mg/cm$^2$ |
| Control-1 | | | 92.5 | 86.5 | 11.0 | 88.1 | E-C | E-D | 148 |
| Control-2 | | | 93.7 | 88.1 | 12.2 | 88.9 | E-C | E-D | 127 |
| 1 | 12 | 250 | 94.1 | 86.2 | 13.2 | 82.8 | E-B | E-D | 100 |
| 2 | 24 | 250 | 95.4 | 87.4 | 14.2 | 82.8 | E-A | E-B | 52 |
| 3 | 8 | 275 | 92.9 | 85.3 | 12.2 | 82.6 | E-B | E-C | 58 |
| 4 | 12 | 275 | 92.6 | 85.4 | 13.3 | 82.0 | E-A | E-B | 44 |
| 5 | 16 | 275 | 92.0 | 85.0 | 11.2 | 84.3 | E-A | E-C | 59 |
| 6 | 24 | 275 | 93.7 | 86.6 | 14.2 | 85.3 | E-B | E-C | 50 |
| 7 | 4 | 300 | 90.5 | 83.5 | 13.2 | 86.2 | E-B | E-C | 55 |
| 8 | 8 | 300 | 91.0 | 83.5 | 14.2 | 83.0 | E-B | E-C | 67 |
| 9 | 12 | 300 | 91.0 | 83.1 | 13.2 | 84.5 | E-B | E-C | 75 |
| 10 | 16 | 300 | 91.7 | 84.3 | 14.2 | 86.4 | E-B | E-D | 102 |
| 11 | 24 | 300 | 92.2 | 85.5 | 15.2 | 85.7 | E-C | E-D | 126 |

Notes:
(1) Offset equals 0.2%
(2) Ratings based upon ASTM standards for exfoliation (Designation G-34-79) with A through D categories, D being most severe.

TABLE III

MECHANICAL PROPERTY AND ACCELERATED EXFOLIATION TESTS, 0.156 IN THICK SAMPLES

| | Aging Treatment | | Longitudinal Properties Tensile | | | Compressive Yield | 24 Hr. EXCO Test | 48 Hr. EXCO Test | |
|---|---|---|---|---|---|---|---|---|---|
| Sample No. | Time (hr) | Temp. (°F.) | T.S. ksi | Y.S. (1) ksi | % El. | Strength (1) ksi | ASTM Visual Rating (2) | ASTM Visual Rating (2) | Weight Loss mg/cm$^2$ |
| Control-1 | | | 93.9 | 88.6 | 11.5 | 88.7 | E-C | E-C | 63 |
| Control-2 | | | 93.8 | 89.4 | 12.0 | 89.4 | E-C | E-D | 72 |
| 1 | 12 | 250 | 99.9 | 92.7 | 13.2 | 85.4 | E-B | E-C | 72 |
| 2 | 24 | 250 | 100.2 | 93.5 | 13.2 | 87.7 | E-B | E-D | 58 |
| 3 | 8 | 275 | 98.0 | 92.2 | 12.5 | 87.5 | E-B | E-C | 36 |
| 4 | 12 | 275 | 98.4 | 92.5 | 12.5 | 88.2 | E-B | E-D | 48 |
| 5 | 16 | 275 | 98.4 | 92.8 | 12.5 | 88.5 | E-C | E-C | 80 |
| 6 | 24 | 275 | 95.9 | 90.3 | 11.8 | 94.1 | E-A | E-C | 64 |
| 7 | 4 | 300 | 97.8 | 92.0 | 12.5 | 87.5 | E-A | E-C | 68 |
| 8 | 8 | 300 | 97.1 | 91.4 | 11.8 | 87.5 | E-A | E-C | 65 |
| 9 | 12 | 300 | 97.5 | 92.2 | 11.8 | 88.5 | E-B | E-C | 90 |
| 10 | 16 | 300 | 96.9 | 91.2 | 11.1 | 88.8 | E-B | E-C | 80 |
| 11 | 24 | 300 | 96.7 | 90.8 | 11.8 | 88.8 | E-C | E-C | 81 |

Notes:
(1) Offset equals 0.2%
(2) Ratings based upon ASTM standards for exfoliation (Designation G-34-79) with A through D categories, D being most severe.

EXAMPLE 2

To further illustrate the invention, samples prepared in accordance with Example 1 and aged for varying time periods of 8 to 24 hours at 275° F. in accordance with the invention were exposed for 12 months to a seacoast atmosphere at Point Judith, R.I. As in Example 1, control panels using the same alloy but using the conventional two-step aging process described in Example 1 were also exposed. As a further control, 0.250 inch and 0.8 inch thick samples of Alloy 7075-T 6511 were also exposed. This alloy, while not possessing the mechanical properties of the alloy used in the invention, is known to have good exfoliation resistance. The panels were exposed at a 45° angle with the test surface facing downward toward the earth since exfoliation corrosion is known to develop more quickly on sheltered surfaces. Visual examination of the panels after 12 months showed exfoliation attack on the prior art two-step aged panels of the degree E-C or E-D, whereas the panels aged in accordance with the invention showed milder exfoliation attack of the degree E-A or E-B.

FIGS. 7 and 8, respectively, illustrate the results of this 12 month exposure on the 0.156 inch and 0.80 inch samples. The samples shown in FIG. 7 are listed respectively in Table I as sample No. 4, Sample No. 5 and Control-1. The samples in FIG. 8 conform respectively in Table III. The improved resistance to exfoliation is markedly evident from examination of FIGS. 7 and 8.

Thus, the test results indicate that alloys composed of the recited constituents can be aged in a single step at a temperature of from above 270° F. to 285° F. to produce a product having comparable mechanical properties and improved exfoliation resistance properties to that obtained using the two-step aging processes of the prior art.

What is claimed is:

1. A method for producing a high strength aluminum alloy product characterized by improved resistance to exfoliation which comprises:

(a) providing an aluminum-base alloy consisting essentially of 5.9 to 8.2 wt. % zinc, 1.5 to 4.0 wt. % magnesium, 1.5 to 3.0 wt. % copper, less than 0.01 wt. % boron and not more than 0.04 wt. % chromium with the balance comprising aluminum;

(b) working the alloy into a product;

(c) heating treating the product;

(d) quenching the heat treated product; and (e) aging the product within a temperature range of about 265° F. to 290° F. for.

2. The method of claim 1 wherein the aging is carried out in the range of about 270° F. to 290° F.

3. The method of claim 1 wherein said alloy contains 5.9 to 6.9 wt. % Zn.

4. The method of claim 1 wherein the aging is within 270° F. to 285° F.

5. The method of claim 1 wherein said alloy contains 0.08 to 0.15 wt. % zirconium and less than 0.008 wt. % boron.

6. The method of claim 5 wherein said alloy contains not more than 0.06 wt. % titanium, not more than 0.12 wt. % silicon, and not more than 0.15 wt. % iron.

7. The method of claim 1 wherein said alloy contains 0.5 wt. % maximum other alloying constituents and impurities.

8. A method for producing high strength aluminum alloy product characterized by improved resistance to exfoliation which comprises:

(a) providing an aluminum-base alloy consisting essentially of 5.9 to 6.9 wt. % zinc, 1.5 to 4.0 wt. % magnesium, 1.5 to 3.0 wt. % copper, 0.05 to 0.25 wt. % zirconium; not more than 0.008 wt. % boron, not more than 0.04 wt. % chromium, not more than 0.06 wt. % titanium, not more than 0.12 wt. % silicon, not more than 0.15 wt. % iron, and not more than 0.1 wt. % manganese and the balance comprising aluminum;

(b) working said alloy to produce a product;

(c) heat treating said product;

(d) quenching said product; and (e) aging the product within a temperature range of about 265° F. to 290° F. for about 6 to 60 hours.

9. An improved aluminum alloy having a compressive yield strength of at least 77 ksi and improved resistance to exfoliation comprising an aluminum-base alloy consisting essentially of: 5.9 to 6.9 wt. % zinc, 1.9 to 2.5 wt. % copper, 2.0 to 2.7 wt. % magnesium, 0.08 to 0.15 wt. % zirconium, 0.1 wt. % max. manganese, less than 0.01 wt. % boron, not more than 0.04 wt. % chromium, not more than 0.06 wt. % titanium, not more than 0.12 wt. % silicon, not more than 0.15 wt. % iron the balance comprising aluminum, said alloy being hot worked, solution heat treated, quenched then aged within a temperature range of about 270° F. to 285° F. for about 6 to 30 hours.

10. An improved aluminum alloy product having a compressive yield strength of at least 77 ksi and improved resistance to exfoliation comprising an aluminum-base alloy consisting essentially of: 5.9 to 8.2 wt. % zinc, 1.5 to 3 wt. % copper, 1.5 to 4 wt. % magnesium, 0.05 to 0.25 wt. % zirconium, 0.1 wt. % max. manganese, less than 0.01 wt. % boron, not more than 0.04 wt. % chromium, not more than 0.06 wt. % titanium, not more than 0.12 wt. % silicon, not more than 0.15 wt. % iron, the balance comprising aluminum, said alloy being hot worked, solution heat treated, quenched, then aged, within a temperature range of about 265° F. to 290° F. for about 6 to 60 hours.

11. A method for producing a high strength aluminum alloy product characterized by improved resistance to exfoliation which comprises:

(a) providing an aluminum-base alloy consisting essentially of:

(i) 5.9 to 6.9 wt. % zinc;

(ii) 1.9 to 2.5 wt. % magnesium;

(iii) 2 to 2.7 wt. % copper;

(iv) 0.08 to 0.15 wt. % Zr;

(v) not more than 0.06 wt. % titanium, not more than 0.12 wt. % silicon, and not more than 0.15 wt. % iron;

(vi) less than 0.01 wt. % boron; and (vii) not more than 0.04 wt. % chromium, with the balance comprising aluminum;

(b) working the alloy into a product;

(c) heat treating the product;

(d) quenching the heat treated product; and (e) aging the product within a temperature range of about 365° F. to 290° F. for about 6 to 60 hours.

12. The method of claim 1 wherein aging is for about 6 to 60 hours.

13. The method of claim 1 wherein said alloy contains about 5.9 to 6.9 wt. % Zn and about 0.05 to 0.25 wt. % Zr.

14. The method of claim 8 wherein the alloy contains 0.08 to 0.15 wt. % zirconium.

15. The product of claim 10 wherein the alloy contains 0.08 to 0.15 wt. % zirconium and less than 0.008 wt. % boron.

16. The product of claim 9 wherein the alloy has an EXCO exfoliation rating of EB or better as tested by a 24 hour EXCO test.

17. The product of claim 10 wherein the alloy product has an EXCO exfoliation rating of EB or better as tested by a 24 hour EXCO test.

* * * * *